US005246381A

United States Patent [19]

Tashiro et al.

[11] Patent Number: 5,246,381

[45] Date of Patent: Sep. 21, 1993

[54] ELECTRICAL TERMINAL FOR MODULATOR CONNECTOR

[75] Inventors: Masateru Tashiro; Hideo Furuya, both of Kanagawa, Japan

[73] Assignee: Oki Electrical Cable Co., Ltd., Japan

[21] Appl. No.: 890,253

[22] Filed: May 29, 1992

[30] Foreign Application Priority Data

Jun. 4, 1991 [JP] Japan ..... 3-050285[U]
Jul. 10, 1991 [JP] Japan ..... 3-061674[U]
Feb. 24, 1992 [JP] Japan ..... 4-017388[U]

[51] Int. Cl.[5] ..... H01R 4/24
[52] U.S. Cl. ..... 439/395; 439/676
[58] Field of Search ..... 439/389-407, 439/417-419, 425, 426

[56] References Cited

U.S. PATENT DOCUMENTS 4,270,831 6/1981 Takahashi ..... 439/397
4,679,878 7/1987 Volk ..... 439/425
4,909,755 3/1990 Chen ..... 439/676
5,131,863 7/1992 Gerke et al. ..... 439/395

*Primary Examiner*—David L. Pirlot
*Attorney, Agent, or Firm*—Ronald P. Kananen

[57] ABSTRACT

A terminal for a modular connector comprises a contact portion at an upper side for contacting portion of a modular jack. At a lower side of the terminal a gap separates two bottom portions which are at the terminus of a beveled end portion. The end portions at each side of the gap are beveled in mutually opposite directions for applying squeezing pressure to a wire when pushed downwardly thereon to maintain secure contact between the wire and the terminal.

6 Claims, 5 Drawing Sheets

ELECTRICAL TERMINAL FOR MODULATOR CONNECTOR

BACKGROUND OF THE INVENTION

1. Field of the Invention

The present invention relates generally to an electrical terminal for a modular connector. Particularly the present invention relates to an electrical terminal utilized in telephone connections and the like.

2. Description of the Prior Art

Electrical terminals utilized in telephones, for example, between the telephone body and a handset, or between the telephone body and a wall connection, for facsimile (FAX) machines, computer connections etc., are well known in the art. In such connections, since a plurality of different wires are required to be connected, the use of modular plugs and jacks to simplify such connections are well known.

FIG. 7 shows such a conventional modular plug A. The plug includes a housing B and a plurality of terminal receiving portions E. In each terminal receiving portion E, a terminal T is inserted. As seen in FIG. 8(A), each of the terminals T has an upper edge C for effecting connection between the modular plug A and a corresponding modular jack (not shown).

Referring to FIG. 8(A), a terminal T includes a pointed portion G, on a side opposite the upper edge C. The terminal T is pushed into the terminal receiving portion E such that the pointed portion G is pushed through a jacketing 9 around a wire 7 which rests in an opening D in the lower part of the housing B.

Referring to FIG. 8(B), a cross section of the wire 7, shielding 9 and the pointed portion G of the terminal T is shown. According to this arrangement, severing of the wires within the jacketing frequently occurs causing a resistance of the connection to vary. When the plug is subjected to testing, such as thermal impact testing or heat/humidity cycle testing, substantially wide variation in resistance occurs. It has been required to provide a terminal with consistent resistance properties.

FIG. 9(A) shows a conventional claw type terminal member also known in the art. FIG. 9(B) shows a cross-sectional view of the claw type terminal in contact with a shielded wire. Although the contact resistance of this type of terminal is improved, installation of such a terminal in a standard modular plug causes damage or deformity to the plug housing.

SUMMARY OF THE INVENTION

It is therefore a principal object of the present invention to provide a terminal for modular connectors which overcomes the drawbacks of the prior art.

In order to accomplish the aforementioned and other objects, a modular connector is provided, comprising: a connector housing having a wire insertion opening provided therein, terminal receiving means formed in the connector housing, a plurality of terminals of flexible substantially flat, planar configuration extending on a plane of a longitudinal direction thereof, having a substantially narrow transverse dimension and formed of electrically conductive material. The terminals are received and maintained in position by the terminal receiving means such that a surface portion of each of the terminals is exposed outside of the connector housing and an end portion of each terminal enters into the wire insertion opening. The end portion of each of the terminals are substantially V-shaped on the longitudinal plane thereof, the V-shaped end portion being separated in a middle portion thereof by a vertical cut-out so as to form two substantially pointed ends. The facing transverse edges of each of the two ends are parallel to each other and each of the two ends are beveled in relation to the longitudinal plane of the terminal in mutually opposite directions at mutually opposite sides thereof such that bottom portions of each end are offset from each other on the longitudinal plane and are provided increased flexibility in the vicinity of the vertical cut-out.

BRIEF DESCRIPTION OF THE DRAWINGS

In the drawings:

FIG. 8 (B) is a cross-sectional view of a conventional terminal member operatively connected to a jacketed wire;

FIG. 9 (B) is a cross-sectional view of the conventional terminal of FIG. 9 (A) operatively connected to a jacketed wire.

DESCRIPTION OF THE PREFERRED EMBODIMENT

Figure 1A:
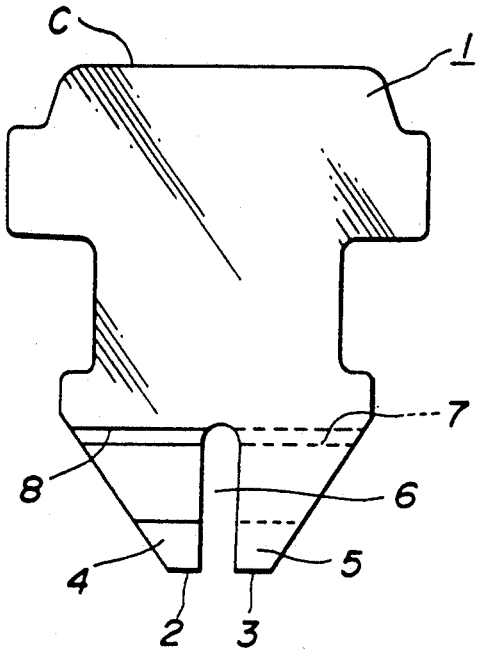
FIGS. 1 (A) and (B) are a plan view and a side view of a terminal according to a first embodiment of the invention, respectively.
Figure 7:
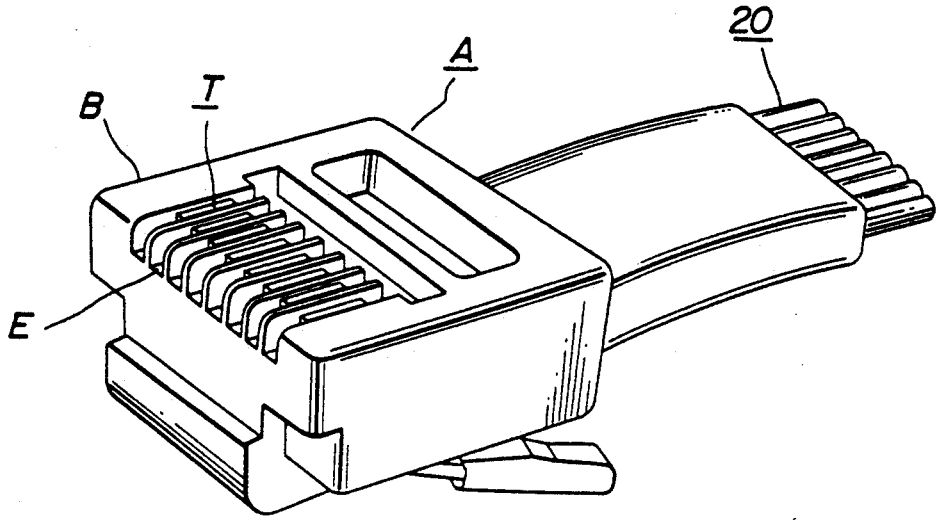
FIG.7 (PRIOR ART)
FIG. 7 is a perspective view of a conventional modular connector.
Figure 8A:
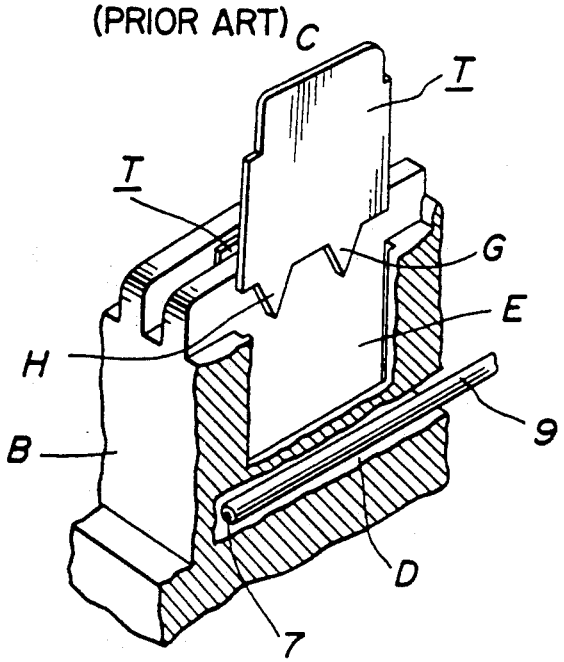
FIG.8(A) (PRIOR ART)
FIG. 8 (A) is a cut away perspective view of a modular connector showing a conventional terminal member and an insertion portion therefor.
Figure 8B:
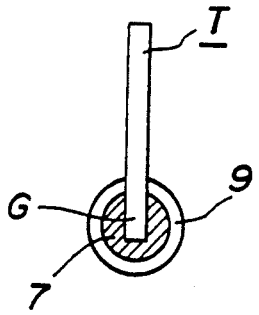
FIG.8(B) (PRIOR ART)
Figure 9A:
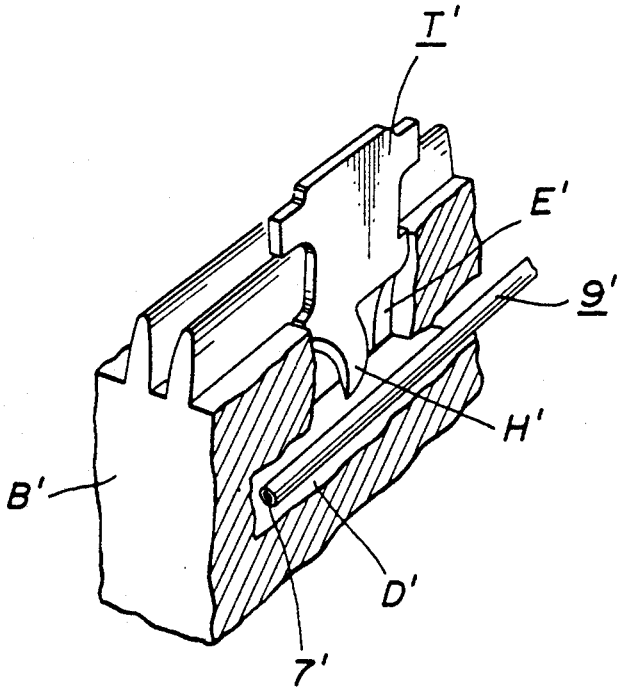
FIG.9(A) (PRIOR ART)
FIG. 9 (A) is a cut away perspective view of a modular connector showing an another type of conventional terminal member and an insertion portion therefor.
Figure 9B:
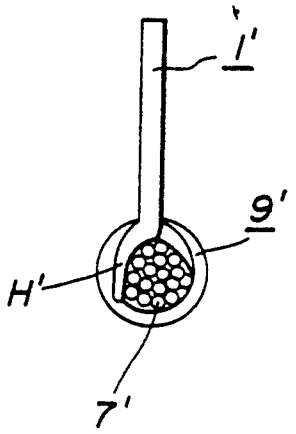
FIG.9(B) (PRIOR ART)

Referring now to the drawings, particularly to FIG. 7 and FIG. 1, a first embodiment of a terminal for a modular connector according to the invention will be described in detail.

As set forth in the description of the background art a modular connector A includes a housing B and a plurality of terminal receiving portions E. In each terminal receiving portion E, a terminal is inserted.

Figure 1B:
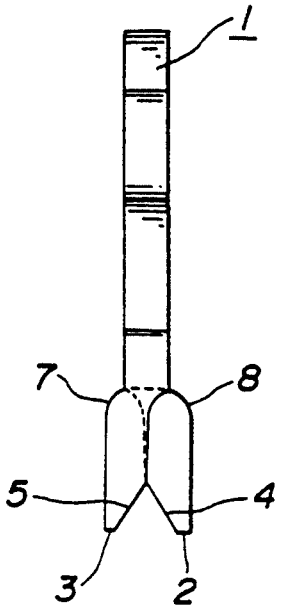

As seen in FIG. 1 (A), a terminal 1 according to the invention has an upper edge C for effecting connection between the modular connector A and a corresponding modular jack (not shown). At a lower end of the terminal 1, two, substantially flat bottom portions 2, 3 are provided, the bottom portions 2, 3 are separated by a gap 6 therebetween, the facing sides of the gap 6 being parallel to each other. Further, lower ends 4, 5 of the terminal are beveled, or angled in mutually opposite directions from an upper side of the lower ends 4, and 5 to the lower side thereof which meet with the bottom portions 2 and 3. At a level corresponding an upper side of the gap 6 offset portions 7, 8 are formed, the offset portions 7, 8 offset the end portions of the terminal 1, which are separated by the gap 6, in opposite directions. FIG. 1(B) shows a cross section of the terminal 1.

Figure 2A:
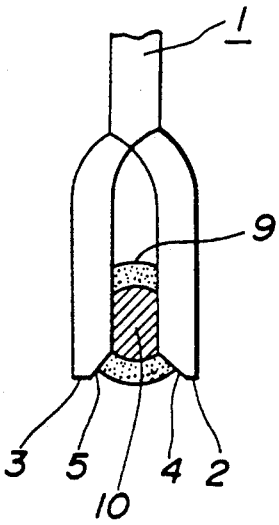
FIGS. 2 (A) and (B) are cross-sectional and bottom views, respectively, of the terminal of FIG. 1 operatively connected with a jacketed wire.
Figure 2B:
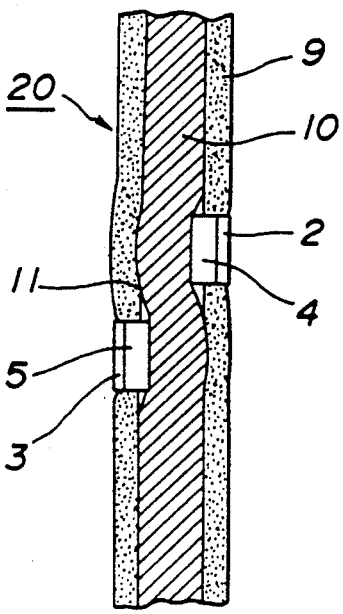

FIG. 2(A) shows the terminal 1 pushingly engaged with a jacketed wire 20, including a sheath 9 and a wire core 10. As may be seen from FIGS. 2(A) and (B), the terminal, when pushed downwardly on the jacketed wire 20, exposes the wire core 10 within the sheath 9 and the angled portions 4, 5 act to squeeze the wire core 10 toward the gap 6, creating a 'pinched' portion 11 in the wire core 10 to insure firm connection between the terminal and the wire core 10. The flat bottom portions 2, 3 firmly and stably hold the terminal 1 inserted into the terminal receiving portion E of the modular connector.

Thus, according to the above construction, a terminal for a modular connector may securely and reliably hold and connect with a jacketed wire and fit easily into the modular connector casing with no need for extensive modification thereof. Further, the terminal of the invention applies continuous squeezing pressure to a wire core of a connected wire for securely and strongly maintaining connection therewith.

Figure 3A:
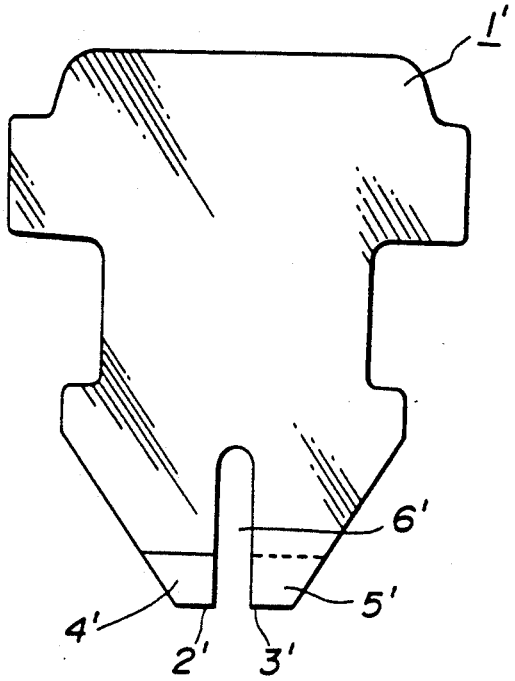
FIGS. 3 (A) and (B) are a plan view and a side view of a terminal according to a second embodiment of the invention, respectively.
Figure 3B:
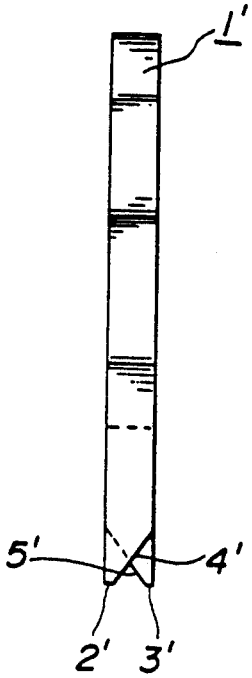
Figure 4A:
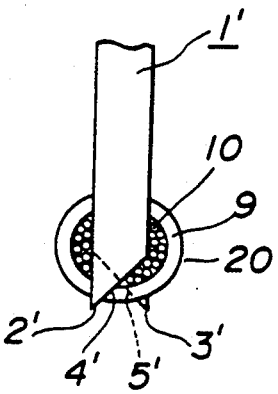
FIGS. 4 (A) and (B) are cross-sectional and bottom views, respectively, of the terminal of FIG. 3 operatively connected with a jacketed wire.
Figure 4B:
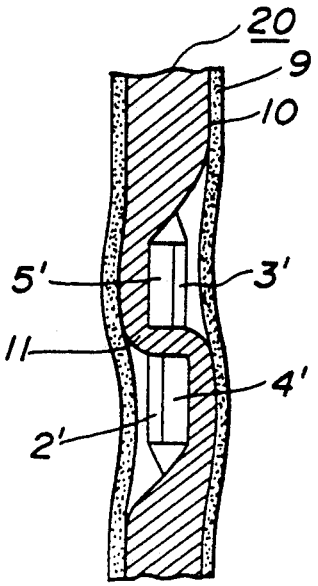

FIGS. 3 and 4 show a second embodiment of a terminal according to the invention as will be described hereinbelow.

As in the above-described first embodiment, a terminal 1' has a gap 6' separating two bottom portions 2', 3'. As in the first embodiment, lower ends 4' and 5' of the terminal are beveled, or angled in mutally opposite directions from an upper side of the lower ends 4, 5 to the lower side thereof which meet with the bottom portions 2' and 3'. According to the present embodiment, the bottom portions 2' and 3' are narrower than those of the first embodiment and no offset portion is provided.

Referring now to FIGS. 4(A) and (B), it can be seen that, as downward pressure is applied to contact the terminal with the wire core 10 of a jacketed wire 20, the bottom portions 2', 3' pierce the sheath 9 of the jacketed wire 20 and the angled portions 4' and 5' serve to form the pinched area 11 in the wire core to establish firm connection between the terminal 1' and the wire core 10. According to the above-described embodiment, the same advantages as the first embodiment are obtained and manufacturing of the terminal is simplified to reduce costs.

Figure 5A:
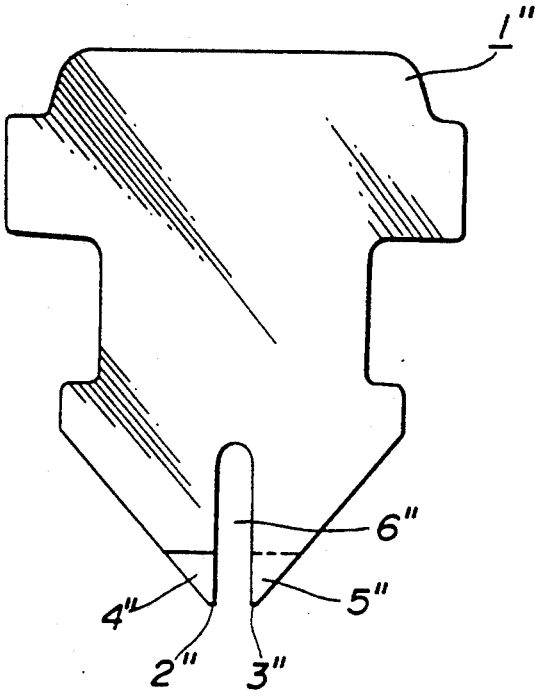
FIGS. 5 (A) and (B) are a plan view and a side view of a terminal according to a third embodiment of the invention, respectively.
Figure 5B:
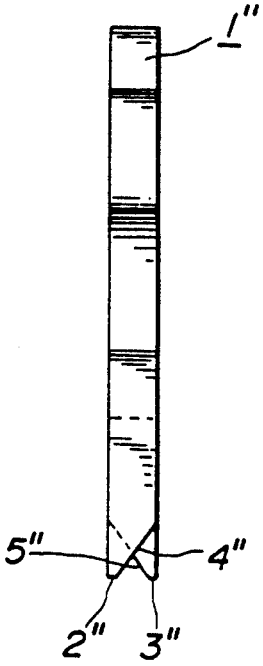
Figure 6:
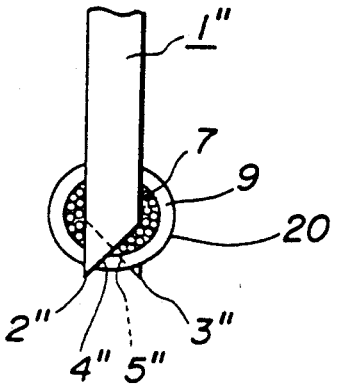
FIG. 6 is a cross-sectional view and bottom views respectively of the terminal of FIG. 5 operatively connected with a jacketed wire.

Referring now to FIGS. 5 and 6, a third embodiment of the invention will be described hereinbelow.

FIG. 5(A) shows a terminal 1" including bottom points 2" and 3" separated by a gap 6". As seen in FIG. 5(B) lower ends 4", 5" of the terminal 1" are beveled in mutually opposite directions as with the first and second embodiments. Referring to FIG. 6, when downward pressure is applied to contact the terminal with the wire core 10 of a jacketed wire 20, the bottom points 2", 3" pierce the sheath 9 of the jacketed wire 20 and the angled portions 4" and 5" serve to form a pinched area in the wire core to establish firm connection between the terminal 1" and the wire core 10. According to the above-described embodiment, the same advantages as the first embodiment are obtained and manufacturing of the terminal is further simplified to reduce costs.

While the present invention has been disclosed in terms of the preferred embodiment in order to facilitate better understanding thereof, it should be appreciated that the invention can be embodied in various ways without departing from the principle of the invention. For example, the above-described embodiments are drawn to terminals connecting to jacketed wires, however, the invention may also be applied terminals connecting to bare wire or shielded cables etc. Therefore, the invention should be understood to include all possible embodiments and modification to the shown embodiments which can be embodied without departing from the principle of the invention as set forth in the appended claims.

What is claimed is:

1. A modular connector comprising:

a connector housing having a wire insertion opening provided therein;

terminal receiving means formed in said connector housing;

a plurality of terminals of flexible substantially flat, planar configuration extending on a plane of a longitudinal direction thereof, having a substantially narrow transverse dimension and formed of electrically conductive material, said terminals being received and maintained in position by said terminal receiving means such that a surface portion of each of said terminals is exposed outside of said connector housing and an end portion of each terminal enters into said wire insertion opening, said end portion of each of said terminals being substantially V-shaped on the longitudinal plane thereof, said V-shaped end portion being separated in a middle portion thereof by a vertical cut-out so as to form two substantially pointed ends, facing transverse edges of each of said two ends being parallel to each other and each of said two ends being beveled in relation to the longitudinal plane of said terminal in mutually opposite directions at mutually opposite sides thereof such that bottom portions of each end are offset from each other on said longitudinal plane and are provided increased flexibility in the vicinity of said vertical cut-out.

2. A modular connector as set forth in claim 1, wherein the bottom portions of said two ends of each of said terminals are flattened in the longitudinal direction.

3. A modular connector as set forth in claim 1, wherein said bottom portions of said two ends of each of said terminals are sharply pointed.

4. A modular connector as set forth in claim 1, wherein said terminals further include offset portions on each side of said vertical cut-out and above said beveled end portions, said offset portions offsetting each of said end portions in mutually opposite directions so as to be spread apart by contact with a wire inserted into said wire insertion opening.

5. A modular connector comprising:

a connector housing having a wire insertion opening provided therein;

at least one terminal receiving opening formed in said connector housing;

at least one terminal of flexible substantially flat, planar configuration formed of electrically conductive material, said terminal having an upper exposed portion and a lower portion received in said terminal receiving opening, said lower portion including a substantially V-shaped lower end portion having a vertical cut-out in the form of a narrow slit extending upwards from an apex of the V-shape to an intermediate portion of the terminal, said cut-out defining parallel facing edges on inner surfaces of said bottom portions and dividing the V-shaped lower end portion of the terminal into two wire-engaging bottom portions each having a lowermost end in communication with said wire insertion opening for engagement with a wire;

said bottom portions of the terminal being co-planar with respect to each other and each having a beveled surface extending upwardly from a point on said lowermost end to an intermediate point on the bottom portion, said beveled surfaces having reversed orientations with respect to each other such that said lowermost ends are offset in a manner to engage and squeeze opposite surfaces of a wire inserted in said wire insertion opening.

6. A modular connector comprising:

a connector housing having a wire insertion opening provided therein;

at least one terminal receiving opening formed in said connector housing;

at least one terminal of flexible substantially flat, planar configuration formed of electrically conductive material, said terminal having an upper exposed portion and a lower portion received in said terminal receiving opening, said lower portion including a substantially V-shaped lower end portion having a vertical cut-out in the form of a narrow slit extending upwards from an apex of the V-shape to an intermediate portion of the terminal, said cut-out defining parallel facing edges on inner surfaces of said bottom portions and dividing the V-shaped lower end portion of the terminal into two wire-engaging bottom portions each having a lowermost end in communication with said wire insertion opening for engagement with a wire;

said bottom portions of the terminal being offset in a direction of their thicknesses with respect to each other and each having a beveled surface extending upwardly from a point on said lowermost end to an intermediate point on the bottom portion, said beveled surfaces having reversed orientations with respect to each other such that said lowermost ends are offset in a manner to engage and squeeze opposite surfaces of a wire inserted in said wire insertion opening.

* * * * *